United States Patent [19]

Nelson

[11] Patent Number: 4,798,388

[45] Date of Patent: Jan. 17, 1989

[54] GAME BOARD

[76] Inventor: Marvin A. Nelson, 801 E. Decker St., Viroqua, Wis. 54665

[21] Appl. No.: 60,685

[22] Filed: Jun. 11, 1987

Related U.S. Application Data

[62] Division of Ser. No. 765,942, Aug. 15, 1985, Pat. No. 4,684,134.

[51] Int. Cl.[4] ..... A63F 3/02; A63F 3/00

[52] U.S. Cl. ..... 273/261; 273/288

[58] Field of Search ..... 273/242, 260, 261, 264, 273/271; D21/24, 33, 34, 36

[56] References Cited

U.S. PATENT DOCUMENTS

| | | | |
|---|---|---|---|
| 529,582 | 11/1894 | Beaman | 273/260 |
| 653,303 | 7/1900 | MacDonald | 273/271 |
| 1,704,819 | 3/1929 | Beaman | 273/261 |
| 3,810,626 | 5/1974 | Elerbe | 273/261 |
| 3,917,272 | 11/1975 | Aldea | 273/260 |
| 3,997,165 | 12/1976 | Barsky | 273/260 |
| 4,045,030 | 8/1977 | Strozewski | 273/260 |

FOREIGN PATENT DOCUMENTS

| | | | |
|---|---|---|---|
| 14317 | 7/1902 | Fed. Rep. of Germany | 273/262 |
| 8523 | of 1904 | United Kingdom | 273/262 |

*Primary Examiner*—Richard C. Pinkham
*Assistant Examiner*—Benjamin Layno
*Attorney, Agent, or Firm*—M. Paul Hendrickson

[57] ABSTRACT

The invention relates to a novel game board, game apparatus and game designed for play by two opposing players. The game is played upon a generally flat surfaced game board which contains a plurality of hexagram playing spaces symmetrically positioned in two outer rows and a plurality of assymmetrical hexagonal playing spaces positioned between the two outer rows. The hexagrams are provided upon the game board in the form of hexagons, the sides of which each have an abutting triangular space. The hexagonal spaces are designed to receive an equal number of major playing pieces for each player while the triangular spaces are designed for receiving minor playing pieces. The major pieces may move into any adjacent hexagonal spacing, provided the pathway remains unguarded by one or more minor playing pieces. The minor playing pieces are permitted only to move forward into adjacent triangular spacings. A capturing move is made by moving a minor playing piece or a major playing piece into a spacing occupied by an opponent's corresponding playing piece and an entrapment is accomplished by blocking an opponent's ability to move a major playing piece.

18 Claims, 3 Drawing Sheets

GAME BOARD

This application is a divisional application of U.S. patent application Ser. No. 765,942, filed Aug. 15, 1985 and now issued as U.S. Pat. No. 4,684,134.

FIELD OF THE INVENTION

The present invention generally relates to a novel game board, game apparatus and game play, and more particularly, it relates to a game board containing a plurality of hexagrams and hexagonal spaces suitably positioned upon the game board so as to enable each player to capture the playing pieces of an opponent player.

BACKGROUND OF THE INVENTION

Mankind has enjoyed for centuries games played upon game boards designed for play by two opposing players. Chess and checkers are representatives of such games. Both games have endured several centuries of play and presently remain popular games amongst game board playing enthusiasts. Much of the success of these two enduring games may be attributed to the game board and strategy of play.

Numerous attempts have been made to modify or improve upon the game of chess and checkers by altering or changing the game board or its game play. For example, U.S. Pat. No. 3,997,165 by Barsky discloses a checkers-like game played upon a game board similar in shape and general appearance to a king game checker board.

The patent literature also discloses games played upon game boards which contain a plurality of hexagonal spaces. U.S. Pat. No. 529,582 by Beaman discloses a game board containing a plurality of hexagonal playing spaces separated by triangular spaces. The Beaman U.S. Pat. No. 529,582 is a game played by moving game pieces from one hexagonal block to another. In another patent issued to Beaman (U.S. Pat. No. 1,704,819), a game board of hexagonal spaces likewise separated by triangular spaces is disclosed. The U.S. Pat. No. 1,704,819 Beaman game board differs from the U.S. Pat. No. 529,582 Beaman game board by its centrally disposed playing area and neutral zones.

Each of the Beaman patents rely upon a game play similar to King's checkers. Similar to checkers, commencement of play is initiated with unkinged playing pieces which are permitted to only move forwardly towards the opponent's side. In both of the aforementioned Beaman patents, the triangular spaces are not a part of the game play. The Beaman patents disclose game boards which contain from 9 to 13 horizontal rows of hexagonal playing spaces with the outer rows thereof being devoid of any outwardly projecting triangles or an outer row arrangement of hexagrams.

U.S. Pat. No. 1,658,503 by Vincent discloses a game board containing triangular spacings with the game play being analogous to checkers except a capturing move is made by surrounding an opponent's playing pieces with the capturing player's pieces in the triangular playing spaces provided upon the game board. In a patent issued by Eberle (U.S. Pat. No. 3,810,626) there is a game board disclosed which may vary in size and shape (e.g. square, rectangular, triangular, etc.). The Eberle game board may be folded so as to alter available sections of play such that the entire board, three-quarters, one-half, or one-quarter may be used for playing various levels of skill. Another game board composed of 58 connected and staggered hexagonal playing spaces is disclosed in U.S. Pat. No. 3,917,272 by Aldea. A further variation of a game board of a general rectangular or square playing surface with hexagonal playing spaces positioned at a 45 degree angle to one another is disclosed in U.S. Pat. No. 4,045,030 by Strozewski.

Recognizing the relatively simplistic but challenging attributes of kings checkers and the more complex and difficult game play of chess, the inventor created and developed a game played upon a game board embodying a unique hexagram and hexagonal playing space arrangement. The game board and its strategy of play combine the more desirable attributes of checkers and chess into a single game. The present game board and game play provides each player with two different classes of playing pieces. One class has greater flexibility in movement than the other class of playing pieces. Unlike checkers and chess, the complexity of the game play may be tailored to meet the required degree of playing skill simply by altering the available number of hexagonal playing spaces upon the game board. The game board may be suitably adapted for play by players ranging from pre-school age to mature adults. The game embodies easy-to-learn mechanics of play in combination with a complex strategy of play. The game board and the strategy of game play affords a wide variety of playing combinations and permutations so as to captivate the interest of the game players.

DESCRIPTION OF THE INVENTION

Figure 1:
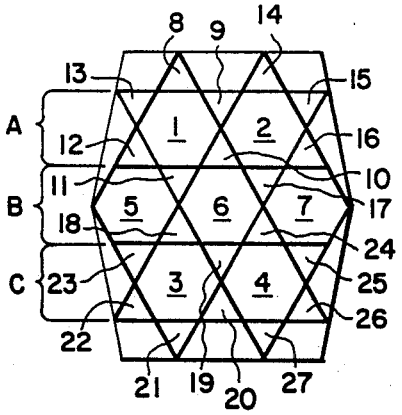
FIG. 1 is a top plan view of a game board comprised of seven (7) hexagonal playing spaces having a matching pair of outer row hexagrams separated by an inner row of three (3) hexagons complemented by a total of 20 triangular playing spaces which collectively provide a playing arrangement in combination with the hexagonal positioning thereupon.

According to the present invention there is provided a game apparatus comprised of a game board and game playing pieces, said game board comprising a plurality of hexagonal spaces and a plurality of triangular spaces systematically arranged upon the game board and abutting the sides of the hexagonal spaces so as to provide in combination with said hexagonal spacings an arrangement of a plurality of hexagrams, said plurality of hexagrams being arranged upon said game board in a first outer row of horizontally aligned hexagrams, a second outer row of horizontally aligned hexagrams of an equivalent number hexagrams as contained in said first outer row, and an inner row further characterized as having a plurality of horizontally aligned hexagons the number of which hexagonal spaces within said inner row exceeds the number of hexagonal spaces of said first outer row, said horizontally aligned hexagonal spaces or said inner row being positioned upon said game board in diagonal alignment with the hexagonal spaces of said first outer row and said second outer row, said game pieces comprising a set of major playing pieces for each player and a set of minor playing pieces for each player with said set of major playing pieces being adapted for emplacement upon the hxagonal playing spaces of the game board and said set of minor playing pieces being adapted for emplacement upon the triangular playing spaces of the game board abutting the sides of said hexagonal playing spaces.

In another embodiment of the present invention there is provided a method for playing a game upon a game apparatus comprised of a game board, a set of major playing pieces adapted for use by opposing players and provided with means of identifying the major playing pieces of each opposing player and a set of minor playing pieces adapted for use by opposing players and provided with means of identifying the minor playing pieces of each opposing player, said game board comprising a plurality of horizontally aligned hexagonal spaces and a plurality of triangular spaces abutting the sides of the hexagonal spaces so as to provide in combination therewith an arrangement of a plurality of hexagrams upon said game board, said plurality of hexagrams being arranged upon said game board so as to provide a first outer row of horizontally aligned hexagrams, a second outer row of horizontally aligned hexagrams the number of which equals the number of hexagrams contained in said first outer row, and an inner row of horizontally aligned hexagonal spacings the number of which hexagonal spacings exceeds the number of hexagonal spaces provided within said first outer row, said horizontally aligned hexagonal spaces of said inner row being positioned upon said game board in diagonal alignment with the hexagonal spaces of said first outer row and said second outer row; said game pieces comprising a set of major playing pieces for each player and a set of minor playing pieces for each player with said set of major playing pieces being adapted for emplacement upon the hexagonal playing spaces of said game board and said set of minor playing pieces being adapted for emplacement upon the triangular playing spaces abutting the sides of said hexagonal playing spaces provided upon said game board, said method of playing said game with said game apparatus comprising;

(a) placing a plurality of major playing pieces of the first player in the hexagonal playing space of each hexagram in the first outer row and a sufficient number of juxtapositioned major playing pieces in hexagonal playing spaces of the inner row beginning with an outside positioned hexagonal playing space so as to permit each player to place an equal number of major playing pieces within the available hexagonal playing spaces of said inner row;

(b) placing an equal number of major playing pieces of the second player in the second outer row and said inner row with the placement of said major pieces in the inner row beginning with the hexagonal playing space opposite from the side from the horizontal placement of the major piece placement by the first player in said inner row;

(c) placing a plurality of minor playing pieces of the first player in each of the triangular playing spaces abutting the sides of the hexagonal playing spaces of the first outer row so as to surround each major playing piece therein with six (6) minor pieces, and correspondingly placing an equal number of minor playing pieces for the second player in each of the triangular playing space abutting the sides of the hexagonal playing spaces of the second outer row to surround each major playing piece of the second player with six (6) minor playing pieces of the second player; and (d) commencing game play by alternating the moves of the game playing pieces upon the game board between the players and each player proceeding to capture the major playing pieces and the minor playing pieces of the other player with each player permitted to move only one (1) game playing piece per move under game play rules wherein a minor playing piece may only forwardly move into an adjacent triangular playing space and said major playing pieces may only move into any juxtapositioned hexagonal playing space provided neither of the triangular playing spaces abutting the side of the hexagonal playing space in the direction of movement of said major playing piece contains a minor playing piece of either player; and (e) sequentially alternating the permissible moves between the first player and the second player with each player proceeding in an attempt to capture the major playing pieces of the other player with the capture of a minor playing piece being effectuated by moving a minor playing piece by the moving player into an adjacent triangular playing space occupied by a minor playing space of the opposing player and the capture of a major playing piece of the capturing player being effectuated by moving a major playing piece into a hexagonal space occuppied by a major playing piece of the opponent player.

The game play is suitably continued until either the first player or the second player has captured or entrapped all of the major playing pieces of the opposing player.

The embodiments of the game board, game apparatus and game play may be more fully appreciated by referring to the Figures. FIGS. 1–3 and 17 depict four (4) game boards embodying a similar pattern of hexagram arrangement but differing in number of playing spaces and required playing skill. FIGS. 4–16 depict the positioning of the game pieces upon the game board. FIGS. 4–13 simulate the game play between two (2) opposing players up to a move which results in the capturing of a major playing piece by one (1) of the players. FIG. 17 depicts a game board in which two (2) additional equilateral triangular spacings have been added to each of the outermost hexagons of the inner row so as to provide each hexagon therein with a full complement of the hexagram therein.

With reference to FIG. 1, FIG. 1 is a plan view of a game board embodying the systematic arrangement of hexagonal and triangular playing spaces. The game is designed to be played by two (2) opposing teams of players, and preferably by two (2) players. The game board depicted by FIG. 1 provides a less complicated game play than the game boards of FIGS. 2–17. The FIG. 1 board is primarily designed for game play by beginning or the lesser mature players. The game board of FIG. 1 is comprised of seven (7) hexagonal playing spaces (1–7 inclusive) and twenty (20) abutting triangular playing spaces numerically designated by the numbers 8–27 inclusive. Each player, upon commencement of game play, is permitted an equivalent number of playing pieces positioned upon the game board.

The hexagonal playing spaces (1–7) are systematically arranged in three (3) horizontally aligned rows generally designated by the alphabetical enumeration A, B and C with the first outer row (top of FIG. 1) being designated as row A the inner row (designated as B) and the second outer row (bottom row of FIG. 1) being generally designated by C. Rows A, B, and C respectively consist of two (2), three (3) and two (2) hexagonal playing spaces. Although the game board may be comprised of two (2) outer rows and more than one inner row (advantageously two or less), the game board will preferrably consist of two (2) outer rows and only one (1) inner row of hexagonal spacings.

In addition to the hexagonal playing spaces 1–7 inclusive, the unique game board of this invention also embodies a systematic arrangement of equilateral triangular playing spaces generally designated by the numerical enumerations 8–27 inclusive, each of which positionally abut the respective sides of the hexagonal playing spaces positioned in outer rows A and C. The hexagonal playing spaces of outer rows A and C in combination with the triangular playing spaces 8–27 form a unique patterned arrangement of one hexagram for each hexagonal playing space horizontally positioned in the first outer row A and second outer row C. The sides of the hexagonal playing spaces positioned on the outer periphery of the game board (namely of rows A and C) are each provided with a plurality of unshared equilateral triangular playing spaces as may be seen by referring to the unshared triangular equilateral spaces 8, 12 and 13 which abut hexagonal playing space 1 of row A; 14, 15 and 16 for which abut hexagonal playing space 2 of row A; and in row C in triangular playing spaces 21, 22 and 23 abutting hexagonal playing space 3, and unshared triangular playing spaces 25, 26 and 27 which abut the outer periphery sides of hexagonal playing space 4. Each hexagonal space positioned in the outer rows (A and C) will also characteristically possess a pair of unshared playing triangular spaces, except with inner row, one (1) of which perpendicularly projects inwardly towards inner row B and the other perpendicularly projects outwardly from the horizontal hexagonal spacing alignment therein. These unshared inwardly and outwardly projecting equilateral triangular spaces are respectively depicted in FIG. 1 as 11 and 8 for 1, 17 and 14 for 2, 21 and 18 for 3, and 27 and 24 for 4. The apex of each inwardly and perpendicular projecting triangular space juxtapositioned to a hexagonal space positioned in the outer rows will tangentially abut the apex of another triangular playing space vertically positioned as part of an outer row hexagram opposite therefrom. An imaginary line vertically bisecting the uppermost sides of horizontal spacings 3 and 4 and the apex of triangular playing spaces 18 and 21, and 24 and 27 of row C will also respectively bisect the vertically matching and paired hexagonal playing spaces 1 and 2 of row A.

The systematic and patterned arrangement of playing spaces afforded by the present board includes an unshared inwardly and horizontally extending triangular playing spaces abutting the innermost side of each hexagonal playing space positioned in the outer rows (A and C). Each hexagonal playing space horizontally positioned in the outer rows (A and C) shares a pair of triangular playing spaces with another internally disposed and adjacent horizontal playing space. This is shown by referring to FIG. 1 wherein equilateral triangular playing spaces 9 and 10 are shared by horizontal playing spaces 1 and 2 while correspondly 19 and 20 of row C are shared by horizontal playing spaces 3 and 4.

The systematic and patterned relationship of the outer row hexagonal playing spaces and triangular playing spaces collectively provide an arrangement of a plurality of hexagrams strategically positioned upon the game board. Thus the combination of hexagonal playing space 1 in conjunction with triangular playing spaces 8, 9, 10, 11, 12 and 13, form a hexagram while triangular playing spaces 14, 15, 16, 17, 10 and 9 in conjunction with hexagonal playing space 2 provide another hexagram arrangement upon the game board. Similarly a matching arrangement of two (2) hexagrams may be seen in row C by the combination of triangular spaces 18–23 inclusive with hexagonal playing space 3 and triangular playing spaces 24, 25, 26, 27, 20 and 19 in conjunction with hexagonal playing space 4. The horizontally aligned hexagrams of outer row A are each vertically paired and vertically aligned with a corresponding hexagram positioned in row C. A similar hexagram arrangement involving shared triangular spaces of both outer rows and the inner rows will also be observed.

The hexagonal playing spaces are arranged upon the game board in such a fashion so as to provide a plurality of diagonally aligned hexagonal spaces. These diagonally aligned hexagonal playing spaces are respectively represented by the diagonal alignment of horizontal playing spaces 5 and 1; 3, 6 and 2; and 4 and 7 and also via the obtusely aligned hexagonal spaces of 3 and 5; 4, 6 and 1; and 7 and 2. The hexagonal spacing arrangements upon the game board are such that the centrally positioned hexagon (i.e. 6 in FIG. 1) or hexagons of FIG. 2 (i.e. 37, 38 and 39) and 3 and 17 (i.e. 84 and 85) will have juxapositioned hexagons at 45°, 90°, 135°, 180°, 225 and 270 thereto in relation to the major plane of their respective vertical axis thereto.

The manner in which the hexagonal and triangular playing spaces are systematically arranged upon the game board in a plurality of hexagrams renders each of the triangular playing spaces to be laterally or vertically positioned to an adjacent triangular playing position. Each complete hexagram upon the game board will have a triangular spacing the apex of which is positioned at 60° degree intervals.

The triangular playing spaces are used in the game for the positioning of minor playing pieces while the hexagonal playing spaces afford a playing space for the major playing pieces. Upon commencement of play, each player is permitted an equal number of major playing pieces. In reference to the game board illustrated by FIG. 1, each opposing player may place one (1) major playing piece upon each of the outside hexagonal playing spaces and one (1) within row C which leaves the centrally disposed hexagonal playing space 6 vacant. Each triangular space abutting the sides of an outer row hexagonal playing space is used to provide a full complement of the player's minor playing pieces so as to surround the respective hexagonal spaces or major playing space therein with each player's own minor playing pieces. A total of ten (10) minor playing pieces is available for each player upon commencement of the game play for the FIG. 1 game board.

Figure 2:
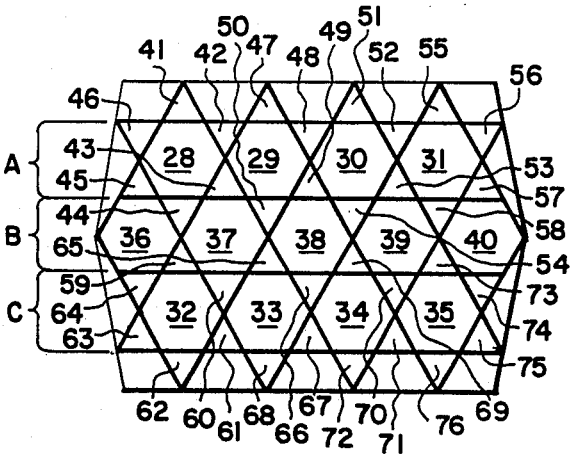
FIG. 2 is a top plan view of a more complicated game board comprised of thirteen (13) hexagons depicting four (4) hexagrams positioned in each of the outer rows separated by a center row of five (5) hexagons in combination with 36 triangular playing spaces systematically arranged upon the game board.

FIG. 2 depicts a plan view of a more complicated game board embodying a similar systematic and patterned arrangement of hexagonal and triangular playing spaces as illustrated by the game board of FIG. 1. The FIG. 2 game board also commonly provides a hexagram for each of the hexagonal spaces positioned within outer rows A and C. Similar to the game board pattern of FIG. 1, hexagonal playing spaces 28, 29, 30 and 31 are horizontally aligned with one another in row A. A similar horizontal arrangement of outer row hexagonal playing spaces may be seen by referring to hexagonal playing spaces 32–35 inclusive and on inner row of 36–40 inclusive. A similar patterned diagonal alignment may be seen by referring to hexagonal spaces 36 and 28; 32, 37 and 29; 33, 38 and 30; 34, 39, and 31; and 35 and 40 with a similar transverse diagonal alignment being observed via 32 and 36; 33, 37 and 28; 34, 38 and 29; 35, 39 and 30; and 40 and 31.

Figure 7:
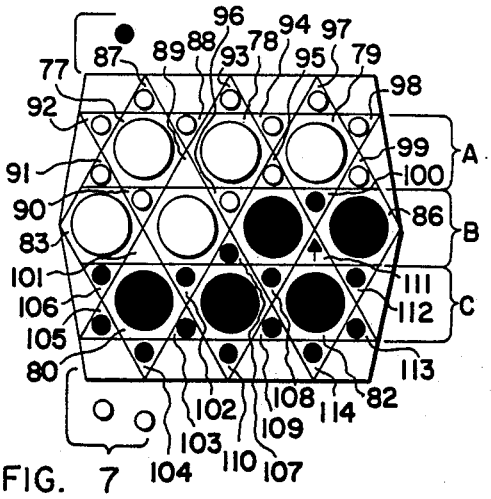
FIG. 7 is a top plan view of the game apparatus depicting an illustrative positioning of the playing pieces after an ensuing second move made by the first player in order to capture a minor playing piece of the second player.

In FIG. 2, each of the hexagonal playing spaces of the outer rows are surrounded by six (6) triangular playing spaces some of which are shared with only the adjacent hexagonal playing spaces. Accordingly hexagonal playing space 28 is surrounded by triangular playing spaces 41, 42, 43, 44, 45 and 46; 29 is surrounded by 47, 48, 49, 50, 43 and 42; 30 is encompassed by triangular playing spaces 51, 52, 53, 54, 49 and 48; and 31 by 55, 56, 57, 58, 53 and 52. Each of these playing spaces and triangular playing spaces of row A form a hexagram pattern about each of the hexagonal playing spaces therein. A similar relationship may be seen by referring to the hexagonal playing spaces 32, 33, 34 and 35 of Row C each of which are respectively surrounded by triangular playing spaces 59, 60, 61, 62, 63 and 64; 65, 66, 67, 68, 61 and 60; 69, 70, 71, 72, 67 and 66; and 73, 74, 75, 76, 71 and 70. Each of these hexagonal playing spaces in combination with the abutting triangular spaces thereto of row C likewise form a hexagramic pattern. It should also be observed that all of the internally disposed hexagonal spaces of inner row B in combination with the triangular spacings abutting thereto also form a plurality of hexagrams upon the game board (e.g. 43, 50, 65, 60, 59 and 44 for 37; 49, 54, 69, 66, 65 and 50 for 38; and 53, 58, 73, 70, 69 and 54 for 39. The same patterned arrangement excepting a lesser number of hexagrams was prevalent in the FIG. 1 game board. The number of hexagrams within the inner row is typically greater (as illustrated by FIG. 7 game board) or one (1) less than the number present in either outer row as illustrated by in FIGS. 1–3 game boards.

Upon commencement of play with the game board as depicted by FIG. 2, each player is permitted to place an equal number of major playing pieces upon the respective outer rows and two (2) contiguous major playing pieces upon the inner row of hexagrams. The most internally disposed hexagonal playing position (i.e. 38) is left vacant. Each of the triangular spaces abutting the major playing pieces in the respective outer rows for each player is provided with a full complement minor playing piece so as to surround the respective major playing piece placement of each player with his own minor playing pieces.

The mechanics of game play upon the game board depicted in FIG. 2 is comparable to that for the game board represented by FIG. 1. The strategy and variations in playing piece movements, however, are more complicated.

Figure 3:
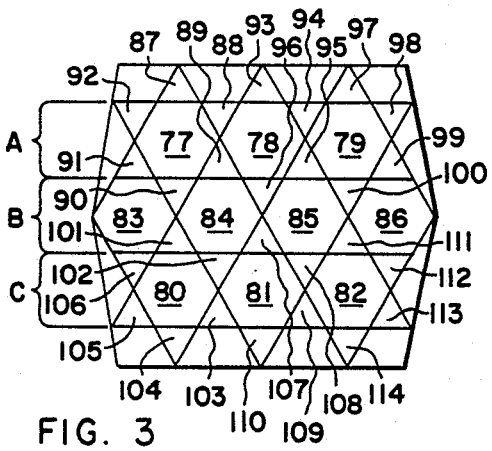
FIG. 3 is a top plan view of a less complicated game board than that shown in FIG. 2 and depicts three (3) hexagrams in each outer row and separated by an inner row of four (4) hexagons.

FIG. 3 depicts a game board designed for play by two (2) opposing players which game board presents a game play strategy more complicated than that of the game board depicted in FIG. 1 but less complicated than the game board depicted in FIG. 2. The game board depicted by FIG. 3 has a plurality of hexagrams positioned in outer rows A and C and affords a playing space for a total of ten 10 major playing pieces (i.e. five for each player) and a total of 28 minor playing pieces. In FIG. 3, the first outer row A and the second outer row C each contain three (3) hexagonal playing spaces while the inner row B is provided with four (4) hexagonal playing spaces (83, 84, 85 and 86). The diagonal and horizontal arrangement between the row A, B, and C hexagonal spacings is also depicted by the FIG. 3 game board. Each hexagonal playing space of the outer rows (A and C) is surrounded by six abutting triangular playing spaces (87, 88, 89, 90, 91 and 92 of 77; 93, 94, 95, 96, 89, and 88 of 78; 97, 98, 99, 100, 95 and 94 of 79; 101, 102, 103, 104, 105 and 106 for 80; 107, 108, 109, 110, 103 and 102 for 84; and 111, 112, 113, 114, 109 and 108 for 82 so as to form a plurality of hexagrams. A pattern of one less hexagram than the number of hexagrams in either outer row may be seen by referring to hexagrams formed by the triangular spaces abutting hexagonal spacings 84 and 85 of the FIG. 3. Each of the hexagrams formed by the triangular spaces and hexagonal spaces of row A are vertically aligned with a matching hexagram positioned opposite therefrom in row C. The game boards illustrated by FIGS. 1 and 2 were provided with a center row which contained an odd number of hexagonal playing spaces. The game board illustrated in FIG. 3 contains an even number of hexagonal playing spaces and therefor each space may be provided with appropriate major playing piece of each player upon commencement of the game play.

Figure 4:
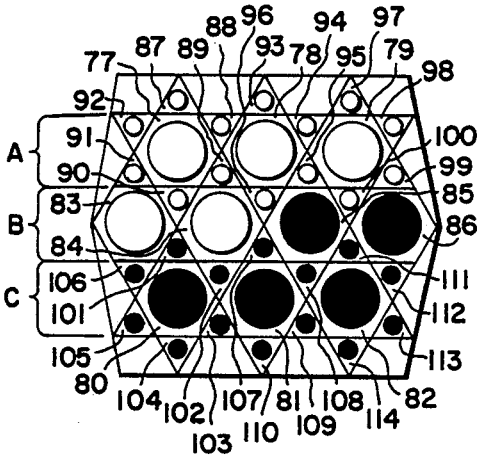
FIG. 4 is a top plan view of the game board apparatus showing the game board of FIG. 3 depicting a suitable positioning of the game playing pieces upon commencement of the game play.

FIG. 4 is a plan view of the game apparatus depicting the game board of FIG. 3 and the positioning of the minor and major playing pieces thereupon at the commencement of the game play. In FIG. 4 the smaller circular objects positioned upon the triangular playing spaces illustrate the positioning of the minor playing pieces upon commencement of play. The larger circles positioned in the hexagonal playing spaces illustrate the placement of the major playing pieces upon commencement of play. The unshaded circles within the hexagonal playing spaces generally depict the positioning of player B's major playing piece while the shaded large circles represent the positioning of the major pieces for player A. Similarly the unshaded small circles within the triangular spaces represent the initial minor playing pieces positioning of player B while the shaded circles represent the minor playing pieces positioning of player A.

Pursuant to the game play, the minor pieces of each player are only allowed to move in a forwardly direction towards the opposing player's minor playing pieces positioning (at commencement of play) with each minor piece being allowed to move only one triangular space per move. In contrast, the major playing pieces are permitted to move into any adjacent hexagonal space (in any direction) provided that the movement into the adjacent hexagonal playing space is not guarded by a minor playing piece of either player. The object of the game is to capture or entrap all of the opponent's major playing pieces. A capturing move is made by moving a playing piece into a space occupied by an opponent's playing piece. Entrapment arises when a player is unable to move any major piece when it is the moving player's turn to make a move.

The minor playing pieces of each player may typically only be captured by the minor playing pieces of the opposing player except under impasse situations more fully described below. In general, major playing pieces may only be captured by the major playing piece of an opponent player. A minor piece is captured when a player moves a minor playing piece into an adjoining triangular playing space occupied by an opponent's minor playing piece. In a preferred embodiment of the game play, each player is required to capture a minor playing piece when it becomes the players turn to move and an adjacent triangular playing space is occupied by the opponent's minor playing piece.

The mechanics of the game play may be more fully appreciated by referring to FIG. 4 which depicts the positioning of the minor and major playing pieces for each player upon commencement of play. Each player in the preferred embodiment of the game paly must mandatorily move a minor playing piece into a space occupied by a minor playing piece of the opponent player when it is the player's turn to move. Upon commencement of game play with the initial positioning of the game pieces, the player entitled to the first move would have a plurality of alternative but mandatory moves. For example, player A could elect to capture the opponent's minor piece by moving the solid minor piece occupying triangular space 101 into the triangular space 90 occupied by the opponent player's minor piece. Another capturing move by player A would be to move the minor playing piece positioned at 107 into the opponent's minor playing piece position 96 or alternatively move the 111 positioned minor piece of player A into triangular space 100 of player B.

FIGS. 5–13 illustrate the sequential moves made by opposing players in simulating game play upon the FIG. 4 game apparatus. The numbering of those playing spaces removed from the actual game play are omitted from FIGS. 5, 6, and 8–16 with the more germane playing positions bearing the same enumeration as the fully referenced game boards of FIGS. 3, 4 and 7. The arrows shown upon the game apparatus illustrated the sequential and alternating moves made by each player.

Figure 5:
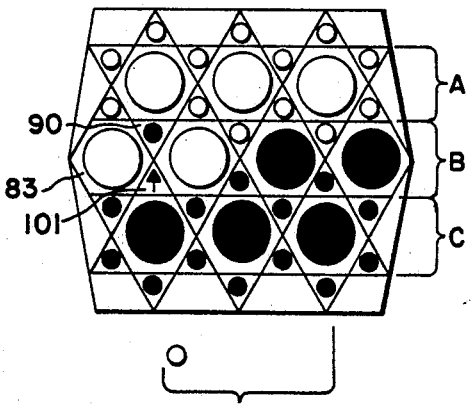
FIG. 5 is a top plan view game apparatus of FIG. 4 showing an illustrative first move of a minor playing piece by the first moving player.
Figure 6:
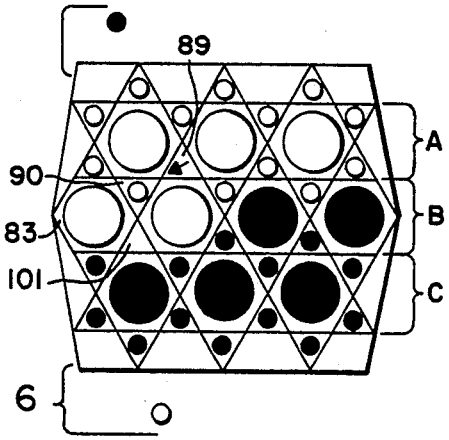
FIG. 6 is a top plan view of the game board and playing pieces depicting the positioning of the game play after an illustrative first move by the second player in capturing a minor playing piece of the first player.

The game players have mutually decided upon which player is entitled to the first move as by the toss of a coin or any other mutually agreeable method of choice. In FIG. 5, player A elected to move the minor playing piece positioned at triangular spacing 101 (a solid shaded piece) into the triangular spacing 90 occupied by the minor playing piece of player B with the playing position and captured minor piece of player B being shown as removed (bracketed portion) from the game board. The arrow shows this move upon the game board of FIG. 5. Player B, in FIG. 6, then elected to move the unshaded minor playing piece positioned at triangular space 89 into adjacent triangular space 90 and thereby captured this minor playing piece of player A. The captured piece is depicted as removed from the game board in a lower bracketed portion below the game board. In the next ensuing move player A elected to move the minor playing piece from triangular playing space 111 into triangular space 100 (occupied by a minor playing piece of player B) with the captured and playing pieces positioning upon the game board thereafter being illustrated by FIG. 7.

Figure 8:
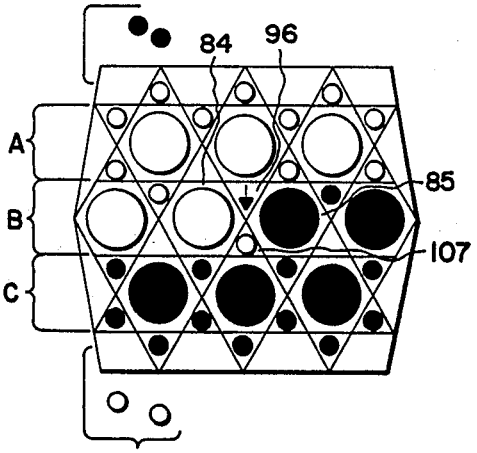
FIG. 8 is a top plan view showing the positioning of the playing pieces upon the game board of FIG. 7 after an illustrative ensuing move (second) made by the second player in capturing a minor playing piece of the first player.
Figure 9:
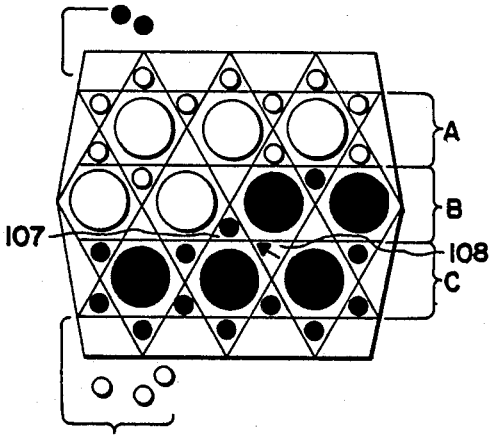
FIG. 9 is a top plan view illustrating the positioning of the game pieces upon the game board after the next simulated move (third) by the first player in the capturing of a minor playing piece of the second player.
Figure 10:
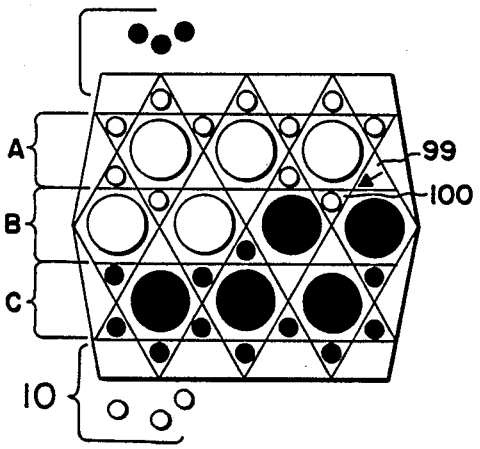
FIG. 10 is a top plan view of the game board and positioning of game playing pieces thereon illustrating the next ensuing move (third) and capture of a subservient playing piece of the first player by the second player.
Figure 11:
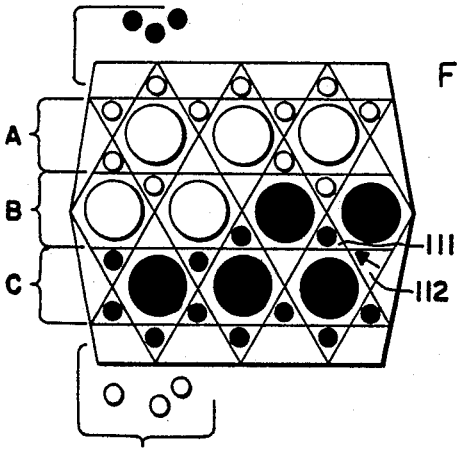
FIG. 11 is a top plan view of the game board and playing pieces depicting an ensuing move of a minor playing device by the (first) player into an unoccupied triangular space.
Figure 12:
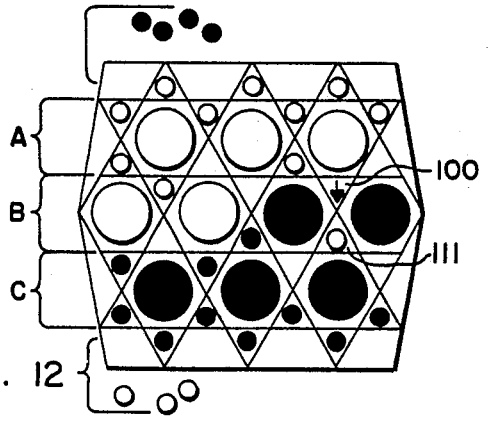
FIG. 12 is a top plan view of the game board and simulated positioning of the playing pieces thereon after the second player has moved (fourth) an unshaded minor playing piece into a triangular playing space occupied by a minor playing piece of the first player and the capture thereof.

The next simulated capturing move by player B was to move the unshaded minor playing piece from triangular playing space 96 into the adjacent triangular space 107 occupied by a solid minor playing piece of player A with positioning of the game pieces upon the game board resulting from such a move being illustrated by FIG. 8. FIG. 9 depicts the next simulated move by player A which entails moving a solid minor piece positioned at 108 into the opponent's minor position 107 and the capture of this minor playing piece of player B. FIG. 10 illustrates the following capturing move by player B with the unshaded minor piece of player B being moved from triangular playing space 99 into triangular space 100. FIG. 11 illustrates the next sequential move of player A in which the solid minor piece positioned at 112 was moved into the adjacent triangular space 111. It may be observed by referring to FIG. 10 that no minor playing piece of player A is now adjacently positioned to a triangular space occupied by a minor playing piece of player B. Accordingly player A (without confronting a mandatory move) elected to move the solid minor piece positioned at triangular space 112 to triangular space 111 with the game positioning of pieces resulting thereby thereafter being depicted in FIG. 11. As illustrated by FIG. 12, player B was thereby confronted with a mandatory move (i.e. from position 100 to adjacent triangular space 111).

Figure 13:
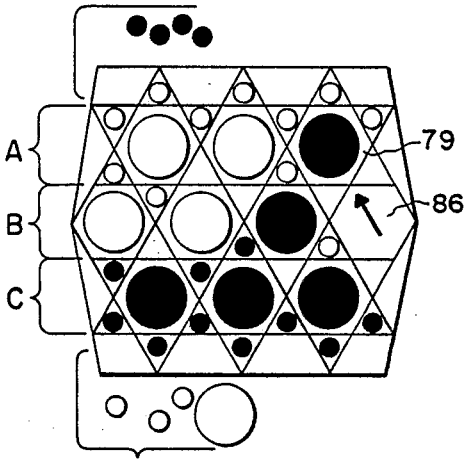
FIG. 13 is a top plan view of the game board apparatus and positioning of the game playing pieces after an ensuing move has been made by the first player to capture a major playing piece of the second player.

The positioning of the minor pieces depicted by FIG. 12 presents the first opportunity for either player to capture an opponent's major piece. The positioning of player A's minor playing piece does not present a mandatory move (in the preferred embodiments of the game play) by player A. Thus, player A may choose to capture or not to capture the opponent's major playing piece. As may be seen by referring to FIG. 12 triangular playing spaces 99 and 100 were unguarded (without minor playing pieces), and accordingly player A may elect to move the solid major playing piece positioned at 86 into hexagonal playing space 79 to capture major playing piece of player B. FIG. 13 simulates the election by player A of such move and shows the positioning of the game pieces upon the game board after such a move has been made. The aforementioned FIGS. 5–13 merely simulate illustrative sequential moves which may be made upon the game board. It should be evident that the players could have made a multitude of other strategic moves other than those illustrated by FIGS. 8–13.

Figure 14:
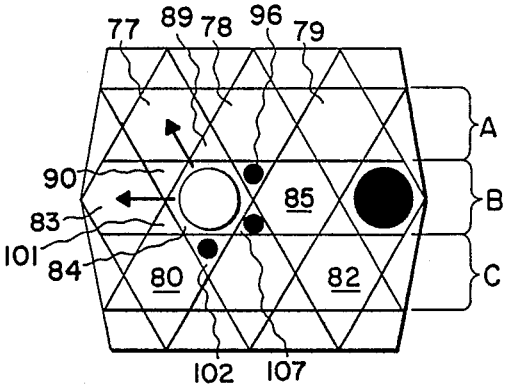
FIG. 14 is a top plan view of the game board apparatus depicting a simulated positioning of game playing pieces.
Figure 15:
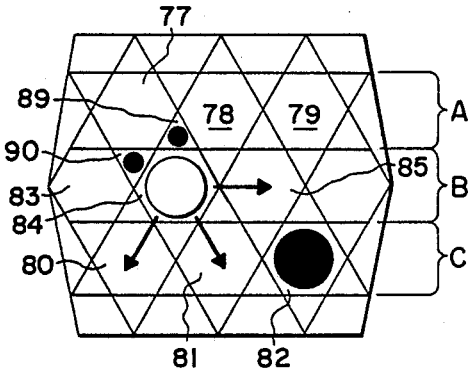
FIG. 15 is a top plan view of the game board apparatus depicting another simulation of game playing pieces upon the game board.
Figure 16:
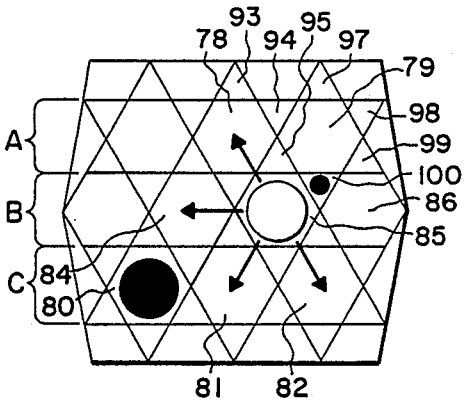
FIG. 16 is a top plan view of the game board apparatus illustrating another arrangement of game playing pieces upon the game board.
Figure 17:
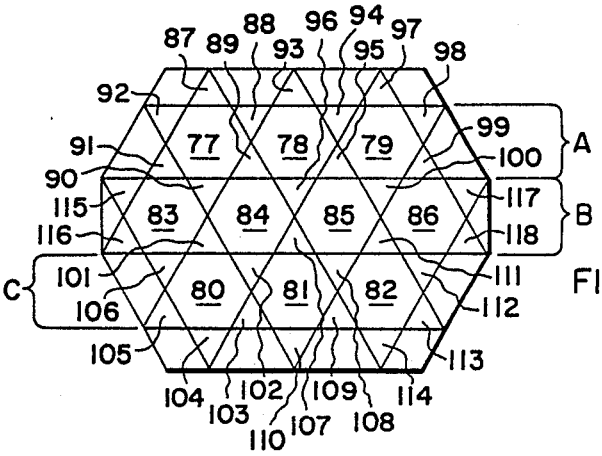
FIG. 17 is a top plan view of a modified form of the game board shown in FIG. 3.

FIGS. 14, 15 and 16 further illustrate various moves which may be made by a major piece when an adjacent triangular playing space is occupied or unoccupied by a minor playing piece. A major playing piece may be moved from a hexagonal playing space to an adjacent hexagonal playing space unless such a move is prevented by occupation of a space abutting thereto by a minor playing piece. The solid arrows, for illustrative purposes in FIGS. 14–16, depict the permissible major piece moves of player B.

FIG. 14 illustratively depicts an unshaded major playing piece (player B) positioned at hexagonal playing space 84 with minor playing pieces occupying the abutting triangular spaces 96, 107 and 102 thereto. Under these simulated circumstances, player B may move the unshaded major playing piece into the unguarded adjacent hexagonal playing spaces 77 and 83, since neither pathway therebetween is guarded by a minor piece. However, movement of the unshaded major playing piece into either adjacent hexagonal playing space identified by 78, 85, 81 and 80 cannot be made due to the positioning of the minor playing pieces of player A at triangular playing spaces 96, 107 and 102. It will also be observed that player A has a major playing piece positioned at hexagonal playing space 86 so that player A may optionally move the major playing piece (upon A's turn of play) into either hexagonal playing space 79, 85 or 82.

In a following move player A may also alternatively elect to move the minor piece positioned in triangular playing space 96 into adjacent triangular spaces 95 or 89 or move the minor playing piece occupying triangular playing space 102 into adjacent triangular space 101. The strategy of the next ensuing move by player A would depend primarily upon the move made by player B. For example, if player B elected to move his major playing piece into 77 then player A elects (not shown) to move his minor playing piece from position 96 to triangular playing space 89. Such an ensuing move (not shown) by player A and positioning of the major playing piece of player B in hexagonal playing space 77 would then restrict the movement of player B's major playing piece to only hexagonal space 83. For purposes of illustrating game strategy, it is assumed that in the following move, player B moved from hexagonal playing space 77 into adjacent hexagonal playing space 83 (not shown). If under these hypothetical circumstances, player A were then to move the solid minor playing piece positioned at triangular playing space 102 into the adjacent triangular playing space 101, player B would then only move (not shown) back to 77. Player B could then move the minor piece position at 101 to 90 and thereby prevent any further movement of the major playing piece of player A positioned at hexagonal playing space 77. This would result in entrapment by player A of player B's major playing piece. Player A would then be declared the winner. As previously mentioned, a minor playing piece is generally not subject to capture by a major playing piece. However, the minor playing pieces may be strategically moved so as to render it impossible for the movement of major piece by an opponent player. This results in entrapment of such a major piece.

FIG. 15 illustrates another situtation wherein player A has a major playing piece positioned at hexagonal playing space 82 and player B has a major playing piece positioned at hexagonal playing space 84. In this illustration, player A also has two (2) minor playing pieces positioned at triangular playing spaces 90 and 89. The positioning of the minor playing pieces at 89 and 90 prevents player B from moving his major piece into adjacent hexagonal playing spaces 77, 78 and 83 which leaves adjacent hexagonal places 85, 81 and 80 available for a move by player A as shown by the arrows. If player B were to move the major piece positioned at hexagonal playing space 84 into 85, then player A upon the next ensuing move could capture the player B major playing piece. Strategically it would therefor be advisable for player B, given the positioning of the game pieces, to move his major piece into adjacent hexagonal playing space 80.

FIG. 16 further illustrates another hypothetical game play situation in which a minor playing piece of player A occupies triangular playing space 100. A major piece of player A occupies hexagonal playing space 80. If player B desires to move his major playing piece into an adjacent hexagonal playing space, movement of such a major playing piece into hexagonal playing spaces 79 and 86 would be unavailable for reason of the positioning of the minor playing piece at triangular playing space 100. The major playing piece of player B, however, could be moved into hexagonal playing spaces 78, 82, 84 and 81, the latter two (2) of which would be inadvisable moves since player A could then capture player B's major piece by a corresponding move into the positions hypothetically occupied by a major piece of player B. In the event that player A should decide to move the minor piece, without moving the major piece, player A would have only five (5) more sequential moves in which to move his minor piece. For example, player A could elect to move his minor playing piece from triangular space 100 to 99 and then on the next move from 99 to 98 and from 98 to 97, and from 97 to off the game board at which point player A would no longer have any remaining forward movements to move his minor playing piece upon the game board. The alternative pathway would be to move from triangular spacing 100 to 95 and then from 95 to 94 and then from 94 to 93 or 97 at which juncture player A would no longer have any further moves of minor playing pieces except for optional game rules which permit the minor piece removal from the game board as the final move therefore.

FIG. 17 illustrates a further variation of the present game boards in which triangular spaces 115 and 116 have been added to outer sides of hexagon 83 in the inner row and corresponding triangular spacing additions (i.e. 117 and 118) to the opposite outer positioned, inner row, hexagon 86. Similar triangular spacing modifications to the game boards of FIGS. 1 and 2 could be made. The illustrative enumerations of FIG. 17 game board are the same as the FIG. 3 game board except the additional triangular playing spaces therein. Such a modified game board version will afford a full complement of hexagrams for each inner row hexagon so as to coincide with those of the outer rows. In such a modified version of the game board, each player would be entitled, upon commencement of game play, to two (2) minor pieces upon the game board with the added triangular playing spaces also being available for game play by the minor playing pieces. Upon commencement of play, each player would be entitled to place two (2) minor pieces in closest proximity to the placement of their respective playing pieces. Thus, playing spaces 115 and 117 would be available for player B while positions 116 and 118 are available for player A.

As previously mentioned, the winner of the game play is normally decided when one (1) of the players has captured or entrapped all of the major game playing pieces of an opponent. An impasse in play could be encountered when neither player can capture all of the major playing pieces of the opponent. Each player may be able to continually move a major playing piece away from the opposing player without either player being able to capture or entrap another's major playing piece. The game board and game play of this invention may be effectively adapted to rules for concluding a win under such circumstances. One (1) player (in an impasse) may have more major playing pieces than the other player and the game rules may advantageously award the win to the player possessing the greater number of major playing pieces.

In alternative game play rules, both players may agree that neither is capable of capturing or entrapping the other's major playing pieces and each player possesses an equal number of major pieces in play. Minor playing pieces may still remain upon the game board but not necessarily in a blocking position. Under such circumstances, the game play rules may advantageously provide that either player may elect to mandatorily restrict subsequent game play moves to minor playing piece movements. Such a player would declare (e.g. prior to his or her turn of actually moving a minor playing piece) that such a move was being made in a attempt to break the impasse deadlock. The opposing player, pursuant to such impasse rules, would then become obligated to move only the minor playing pieces unless the declaring player were to expose a major playing piece to capture. Under such alternative game play rules, the process of alternative moves of the minor playing pieces is repeated until no further minor playing piece movements upon the game board remain for a player. The primary objective is to force the opponent's minor playing piece or pieces off the playing board. The game win may be awarded to the last player who possess a minor playing piece or pieces remaining upon the game board. The final removal of the minor playing piece would arise when a minor playing piece positioned in the outwardly projecting triangular playing space of an outer row was forced to forwardly move off the playing board. The game rules may alternatively provide the win to the player with the greatest number of minor playing piece (not subject to capture) moves remaining upon the game board.

The number of remaining minor playing pieces will only typically affect the game outcome when an equal number of major playing pieces (not subject to capture and entrapment) for both players remain on the board and all other play has been exhausted. If there exists a minor playing pieces disparity and an equal number of major playing pieces amongst the players, the rules may advantageously provide that the player with the largest number of playing pieces has the advantage. Such an advantaged player may, in the preferred embodiments of the game play, elect to make the first play move in an attempt to break the deadlock or may demand that the opponent make the first move. Pursuant to such alternative game rules, the demand should be made prior to the opponent's turn to move. The sequence of alternative moves remains unchanged by such a demand. If such a disadvantaged opponent were under such a demand to refuse to move a minor playing piece under the alternative game play rules, such a player would then advantageously award the win to the advantaged player. Such alternative rules may be instituted in order to determine a winner and thereby prevent repetitive moves or aimless movement of major playing pieces about the board.

Another variation to the game rules may include a situation wherein each player has only one (1) minor playing piece and an equal number of major playing pieces upon the game board. Each player may be unable to capture or entrap the other player's major game piece or pieces. Each game player may have the minor playing pieces positioned upon a triangle in the last row of the opponent's end of the game board. Under these circumstances, neither player can force the other to move such a minor playing piece off the game board. If such a move were to be made, the game rules may suitably provide that the the other player would be the automatic winner since such a player would be the only player having one (1) minor playing piece remaining upon the game board.

The game rules may also provide for a winner to be determined involving an exception wherein a major playing piece may be used to capture a minor playing piece of the other player. Such an exception would advantageously arise only in an impasse situation. Such a game play exception would be preceeded by a declaration of a player's intent to capture an opponent's minor playing piece with a major playing piece. A minor playing piece would then be captured by a major piece by the positioning of a major playing piece in a hexagonal space adjacent to a triangular space occupied by a minor playing piece of the opposing player. A capturing or non-capturing move of such a minor playing piece would depend upon the first arrival of a major playing piece by the declaring player in a hexagonal spacing adjacently positioned triangular space occupied by the opponent's playing piece prior to the arrival similarily adjacent positioned major playing piece of the non-declaring player, in which later case the minor playing piece would become protected. If the non-declaring player were to make a capturing move of a minor playing piece of the declaring player prior to a corresponding capture by the declaring player, the non-declaring player would be awarded the win upon the basis of possessing a greater number of active playing pieces.

In still another variation of the game play, there may be provided a draw situation wherein either player is unable to capture or entrap the opposing players major game piece or pieces. Such a draw could be incorporated into the game rule irrespective whether an equal number of major game playing or other pieces existing upon the game board between the players.

As evidenced by the aforementioned, the game board and game apparatus provides an uniquely different game. The basic major and minor playing piece moves provide a novel and challenging method of game play. The game board may be adopted to a variety of game play rules for concluding a draw or winners without substantially altering its basic and unique methodology of its play. The game pieces may be provided in a variety of shapes, designs, sizes and colors, and in such a manner so as to permit the identification of each player's pieces.

What is claimed is:

1. A game apparatus comprised of a game board and game playing pieces, said game board comprising a plurality of horizontally aligned hexagonal spaces and a plurality of triangular spaces systematically arranged upon the game board with said triangular spaces abutting the sides of the hexagonal spaces so as to provide in combination with said hexagonal spaces an arrangement of a plurality of hexagrams upon said game board, said plurality of hexagrams being arranged upon said game board to provide a first outer row of horizontally aligned hexagrams, a second outer row of horizontally aligned hexagrams of an equivalent number to the hexagrams as contained in said first outer row and an inner row containing at least one (1) hexagram, said inner row being further characterized as containing a greater number of hexagonal spaces than said first outer row with said horizontally aligned hexagonal spaces of said inner row being positioned upon said game board in diagonal alignment with hexagonal spaces of said first outer row and said second outer row, and said game playing pieces comprising of a set of major playing pieces and a set of minor playing pieces for each player with said set of major playing pieces and said set of minor playing pieces respectively adapted for emplacement upon the hexagonal playing spaces and the abutting triangular playing spaces of said game board.

2. The game appartus according to claim 1 wherein the combination of said hexagonal spaces and said triangular playing spaces provide a systematic pattern of horizontally aligned hexagrams positioned in three rows and the number of hexagrams of the game board ranges from 5 to 13 inclusive.

3. The game board apparatus according to claim 2 wherein the triangular spaces and the sides of the hexagonal spaces of the game board form a hexagram arrangement for each of the hexagonal spaces contained within said first outer row and said second outer row, and each of the hexagonal spaces within said first outer row and said second outer row share at least two equilateral triangular spaces with an adjacent hexagonal space.

4. The game board apparatus according to claim 2 wherein the first outer row and the second outer row of the game board each contain two hexagonal spaces and the inner row conatains three hexagonal spaces.

5. The game apparatus according to claim 1 wherein the set of major playing pieces includes at least 3 major playing pieces for each player and the set of minor playing pieces includes at least 10 minor playing pieces for each player.

6. The game apparatus according to claim 5 wherein the number of inner row hexagrams formed by the hexagonal playing spaces of the inner row in combination with the triangular playing spaces abutting the sides of the inner row hexagonal playing spaces is either one greater or one less than the number of hexagrams in said first outer row.

7. The game board apparatus according to claim 5 wherein the horizontal positioning of the hexagonal spaces of the game board consist of three horizontal rows of hexagonal spaces.

8. The game board apparatus according to claim 7 wherein the first outer row and the second outer row of the game board each have three hexagonal spaces and the inner row consists of four hexagonal spaces.

9. The game board apparatus according to claim 7 wherein each of the hexagonal spaces of said inner row abut onto six equilateral triangular spaces.

10. The game board apparatus according to claim 1 wherein the game board consists of 13 hexagonal spaces with five of the hexagonal spaces being positioned within the inner row and the first outer row and the second outer row each contain four hexagonal spaces.

11. A game board adapted for a game playing involving two opposing players equipped with an opposing set of major game playing pieces and an opposing set of minor playing pieces, said game board comprising a plurality of hexagonal spaces horizontally positioned and aligned in rows upon the game board and a plurality of triangular spaces abutting the sides of the hexagonal spaces so as to provide in combination with said hexagonal spaces an arrangement of a plurality of hexagrams, said plurality of hexagrams being arranged upon said game board in a first outer row of horizontally aligned hexagrams, a second outer row of horizontally aligned hexagrams of an equal number of hexagrams as contained in said first outer row and an inner row which contains at least one hexagram, said inner row being further characterized as containing a greater number of hexagonal spaces than said first outer row and said horizontally aligned hexagonal spaces of said inner row are positioned upon said game board in diagonal alignment with the hexagonal spaces of said first outer row and said second outer row, with said hexagonal playing spaces affording upon said game board playing spaces for the emplacement and game play thereupon by the opposing set of major playing pieces and the triangular spaces affording playing spaces for the emplacement and game play thereupon by the opposing set of minor playing pieces.

12. The game board according to claim 11 wherein the triangular spaces and the sides of the hexagonal spaces form a hexagram arrangement for each of the hexagonal spaces contained within said first outer row and said second outer row, and each hexgonal space within said first outer row and said second outer row share at least two triangular spaces with an adjacent hexagonal space.

13. The game board according to claim 12 wherein the first outer row and the second outer row each contain two hexagonal spaces and the inner row contains three hexagonal spaces.

14. The game board according to claim 12 wherein the horizontal positioning of the hexagonal spaces consist of three horizontal rows of hexagonal spaces.

15. The game board according to claim 14 wherein the first outer row and the second outer row each have three hexagonal spaces and the inner row consists of four hexagonal spaces.

16. The game board according to claim 14 wherein the game board consists of 13 hexagonal spaces with five of the hexagonal spaces being positioned within the inner row and the first outer row and the second outer row each contain four hexagonal spaces.

17. The game board according to claim 14 wherein each of the hexagonal spaces of said inner row abut onto six equilateral triangular spaces.

18. The game board according to claim 11 wherein the combination of said hexagonal spaces and said triangular playing spaces provide a systematic pattern of horizontally aligned hexagrams positioned in three rows with the number of hexagrams within said rows ranging from 5 to 13 inclusive.

* * * * *